US005359163A

United States Patent [19]

Woodard

[11] Patent Number: 5,359,163

[45] Date of Patent: Oct. 25, 1994

[54] PUSHBUTTON SWITCH WITH ADJUSTABLE PRETRAVEL

[75] Inventor: Tony O. Woodard, Pine Level, N.C.

[73] Assignee: Eaton Corporation, Cleveland, Ohio

[21] Appl. No.: 53,278

[22] Filed: Apr. 28, 1993

[51] Int. Cl.[5] ..... H01H 1/34

[52] U.S. Cl. ..... 200/249; 200/534

[58] Field of Search ..... 200/249, 251, 530, 534

[56] References Cited

U.S. PATENT DOCUMENTS

| | | | |
|---|---|---|---|
| 1,853,964 | 4/1932 | Dorgeloh et al. | 200/534 |
| 2,946,871 | 7/1960 | De Smidt et al. . | |
| 3,581,025 | 5/1971 | Yeo | 200/249 |
| 3,912,894 | 10/1975 | Mullen et al. | 200/534 |
| 5,063,276 | 11/1991 | Woodard | 200/534 |

FOREIGN PATENT DOCUMENTS

| | | | |
|---|---|---|---|
| 193587 | 3/1967 | U.S.S.R. | 200/249 |

*Primary Examiner*—Renee S. Luebke

*Attorney, Agent, or Firm*—Larry G. Vande Zande

[57] ABSTRACT

A contact carrying portion of a plunger assembly is adjusted linearly in the direction of switch operating movement by a rotatable cam in the plunger assembly to change an initial gap dimension between stationary and movable contacts. The cam is rotatable about an axis parallel to the direction of switch operating movement and comprises a plurality of angularly spaced diametrically oriented grooves, each of a different depth, in an end surface cooperating with a diametrically disposed rib on the contact carrying portion to vary the axial length of the plunger assembly and provide a detent for the cam adjustment. A housing is provided with a window through a lateral wall for accessing slots in the cam to rotate the cam. The pushbutton switch is resiliently disposed in a supplementary housing to accommodate significant overtravel of a switch operating element.

12 Claims, 2 Drawing Sheets

Fig. 9
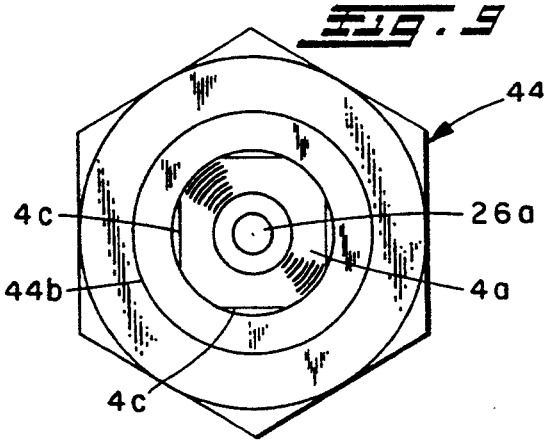
Fig. 6
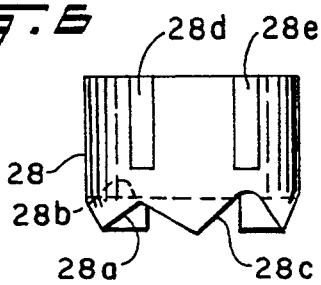
Fig. 7
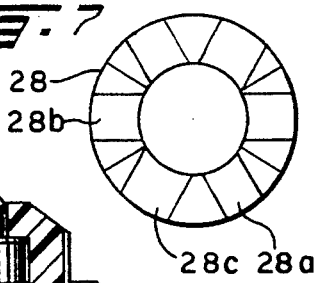
Fig. 10
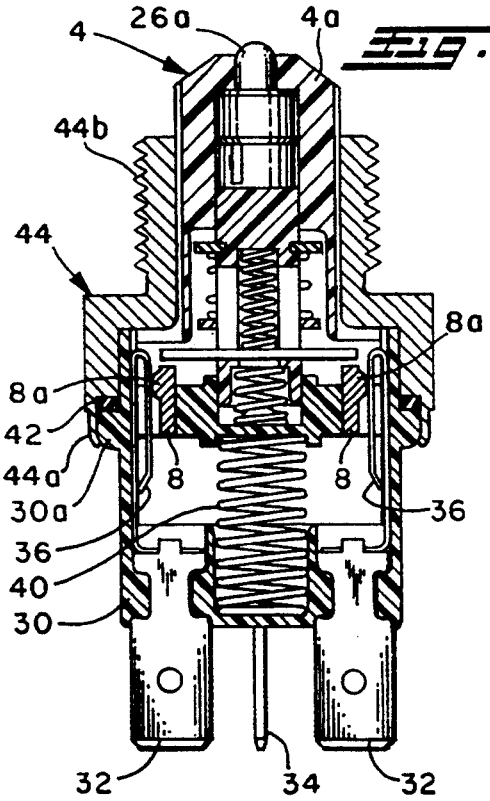
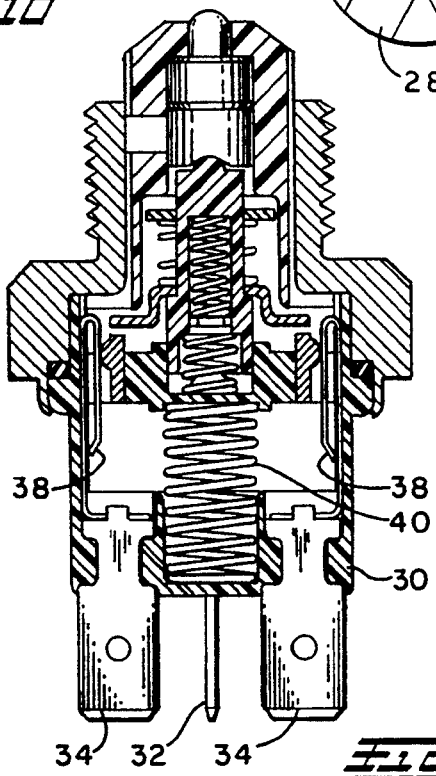
Fig. 11
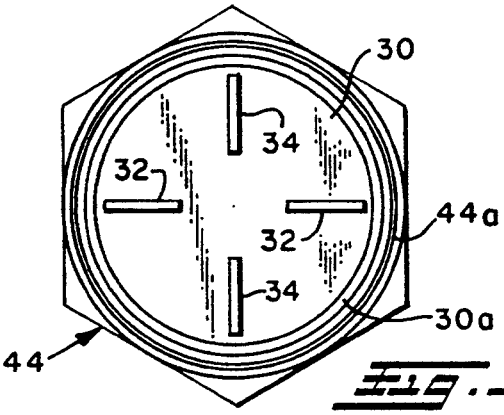
Fig. 12
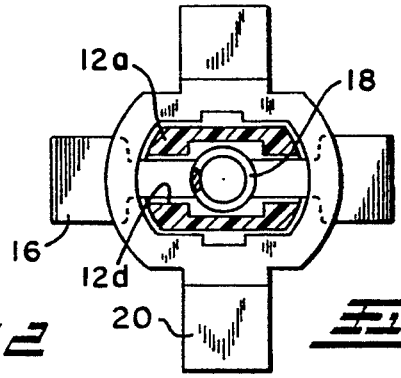
Fig. 8

PUSHBUTTON SWITCH WITH ADJUSTABLE PRETRAVEL

BACKGROUND OF THE INVENTION

This invention relates to pushbutton switches. In particular, the invention relates to pushbutton switches wherein the pretravel, i.e. the distance a movable contact travels to engage the stationary contacts, is adjustable to compensate for tolerance accumulations in the parts.

Pushbutton switches generally comprise a housing, a plunger in the housing carrying a movable contact, stationary contacts in the housing aligned with the movable contact, and springs biasing the movable contact and the plunger away from the stationary contacts. Depression of the plunger moves the movable contact into engagement with the stationary contacts to complete an electrical circuit therethrough. The individual parts and significant features of the parts are dimensioned to establish a specific initial dimension between the movable and the stationary contacts in the extended position of the pushbutton, thereby defining a particular distance the plunger must be depressed before effecting engagement of the movable and stationary contacts. Each part and feature dimension has a manufacturing tolerance. When a plurality of parts are involved, the tolerances may "stack" adversely, thereby significantly changing the initial dimension between the movable and stationary contacts in the extended position and therefore changing the distance the plunger must travel to effect contact engagement. In certain end user applications, consistency of this initial dimension between the movable and stationary contacts is essential.

SUMMARY OF THE INVENTION

This invention provides a pushbutton switch having means for adjusting the initial dimension between the stationary and movable contacts after assembly of the switch. The adjustment means effectively lengthens or shortens an axial dimension of the plunger by rotating an adjustment cam member in the plunger assembly. A window is provided in a lateral wall of the switch housing for access to the adjustment cam member. The cam surface on the adjustment cam member doubles as a detent for the adjustment cam member.

BRIEF DESCRIPTION OF THE DRAWINGS

FIG. 6 is a side elevation view of the adjustment cam member shown in FIG. 5;

FIG. 7 is a bottom plan view of the adjustment cam member shown in FIG. 5;

FIG. 8 is a cross sectional view of the plunger and movable contact members taken along the line 8—8 in FIG. 2;

FIG. 9 is a top plan view of a pushbutton switch assembly showing the pushbutton switch of FIGS. 1-8 assembled into a supplementary switch housing;

FIG. 10 is a center line cross sectional view of the switch assembly of FIG. 9 taken in a plane parallel to the paper;

FIG. 11 is a center line cross sectional view of the switch assembly of FIG. 9 taken in a plane perpendicular to the paper; and FIG. 12 is a bottom plan view of the switch assembly of FIG. 9

DESCRIPTION OF THE PREFERRED EMBODIMENT

The pushbutton switch 2 of this invention comprises a molded insulating housing 4 having a generally cylindrical barrel portion 4*a* and an enlarged cylindrical frame portion 4*b* open to the lower end thereof. Frame portion 4*b* has slots 4*c* located on the orthogonal axes which extend upward as shallow grooves along the exterior surface of barrel portion 4*a*. A molded insulating base 6 has slots 6*a* arranged on the orthogonal axes in alignment with the slots 4*c* of housing 4. Base 6 has one or two pairs of stationary contacts 8 retained in appropriate pockets in the base 6 adjacent the respective inner walls of diametrically opposed ones of the slots 6*a* according to whether the switch is to be a single pole or double pole switch. Base 6 is attached to the lower end of housing 4 by any appropriate method. Although not specifically shown, it is preferred that base 6 and housing 4 are suitably configured for snap together attachment.

Figure 3:
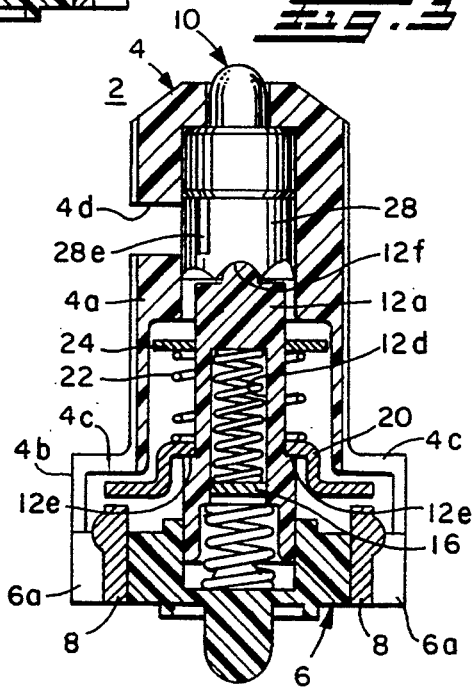
FIG. 3 is a center line cross sectional view of the switch of FIG. 1 taken in a plane perpendicular to the paper.

The barrel portion 4*a* of housing 4 has a multi-stepped cylindrical opening therethrough which is enlarged adjacent the frame portion 4*b* at the lower end of housing 4 and is reduced at the upper end of the barrel. A plunger assembly 10 is disposed within the stepped cylindrical opening of housing 4. The plunger assembly comprises a contact carrier 12 molded of insulating material. Contact carrier 12 is an elongated member generally symmetrical about an axis extending longitudinally therethrough. The upper portion 12*a* of contact carrier 12 is generally cylindrical complementally to the bore of housing 4. The lower end 12*b* of contact carrier 12 has a rectangular shape, preferably square, to be complementally received in a square recess 6*b* of base 6 to prevent rotation of contact carrier 12 about the longitudinal axis. The lower end 12*b* has a cylindrical recess 12*c* for receiving one end of a helical compression spring 14, the other end of which is positioned by a semispherical boss molded in the bottom of recess 6*b*. Spring 14 biases contact carrier 12 upwardly toward the reduced diameter end of barrel 4*a*. Contact carrier 12 is also provided with a window 12*d* extending diametrically therethrough above the end portion 12*b*. A flat movable contact 16 is disposed within the window 12*d* having opposite ends projecting out opposite sides of the contact carrier. The opposite ends of movable contact 16 are widened in a bow-tie fashion to maintain the movable contact positioned relative to the contact carrier and to match the contact faces of the stationary contacts 8. Contact 16 is biased against a bottom edge of window 12*d* by a helical compression spring 18 positioned within a widened central recess of the contact carrier. Movable contact 16 is used in a single pole switch arrangement. A double pole switch arrangement is shown in the drawings and is provided by a second movable contact 20 which is disposed over the exterior of the movable contact carrier 12. As can be seen in FIG. 8, contact carrier 12 and movable contact 20 are provided with flat surfaces and edges, respectively, to prevent rotation of movable contact 20 about the contact carrier 12. As can be seen in FIG. 3, the opposite ends of movable contact 20 are offset downwardly to be substantially coplanar with the opposite ends of movable contact 16. The opposite ends of movable contact 20 overlie a respective diametrically opposed pair of stationary contacts 8 which are 90 degrees displaced from the stationary contacts 8 associated with movable contact 16. A helical compression spring 22 is disposed around contact career 12 to bear upon movable contact 20. The opposite end of spring 20 bears against a C-ring 24 attached to the contact career 12. Movable contact 20 rests upon step ledges 12*e* provided on the periphery of contact carrier 12 as shown in FIG. 3.

The contact career 12 could comprise an integral portion extending upwardly through the reduced size opening at the upper end of barrel portion 4*a* of housing 4 and thus be a one piece plunger assembly. However, the contact carrier 12 is molded of a plastic-type material which is electrically insulative. The end use applications of such switches commonly employ a metal machine part operating the switch by depressing the plunger. The dissimilar materials and the nature of the engagement therebetween tends to cause excessive wear which affects the amount of travel of the machine element before actually causing the plunger to be depressed sufficiently to operate the contacts. Accordingly, an operator 26 is commonly used to alleviate the wear, the operator being a machined metal part or other high wear resistant material placed between the end of contact carrier 12 and the upper end of barrel portion 4*a*. In the switch embodiment shown, the operator 26 is a cylindrical member having a reduced diameter pin portion 26*a* extending upwardly therefrom through the opening in the end wall of housing 4. While the operator 26 improves the wear resistance, it adds still another individual part to the switch and may add to any adverse tolerance accumulations in the switch which determine the original, dimension X (FIG. 1) between the movable contacts 16 or 20 and the respective stationary contacts 8.

Figure 4B:
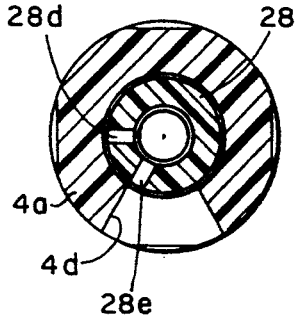
FIG. 4*b* is a view like 4*a* showing the adjustment cam member in a clockwise rotated position.
Figure 4A:
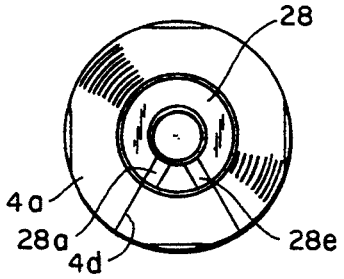
FIG. 4*a* is a cross sectional view taken along the line 4—4 in FIG. 1 showing the adjustment cam member in a first position.
Figure 4C:
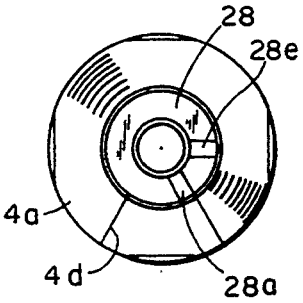
FIG. 4*c* is a view like 4*a* showing the adjustment cam member in a counterclockwise rotated position.
Figure 1:
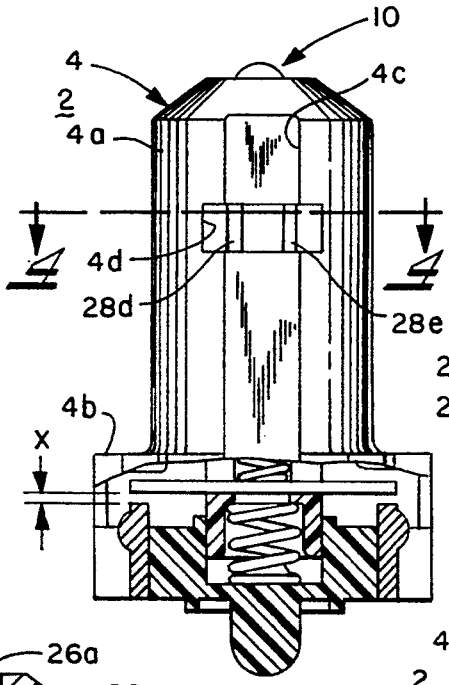
FIG. 1 is a side elevation view, partially broken away, of the pushbutton switch with adjustment means constructed in accordance with this invention.
Figure 5:
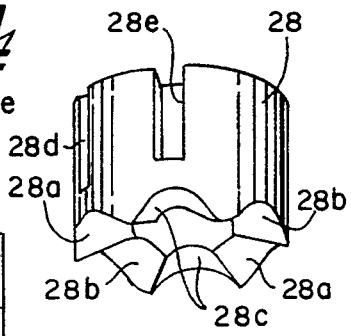
FIG. 5 is a perspective view of the adjustment cam member for the pushbutton switch constructed in accordance with this invention.
Figure 2:
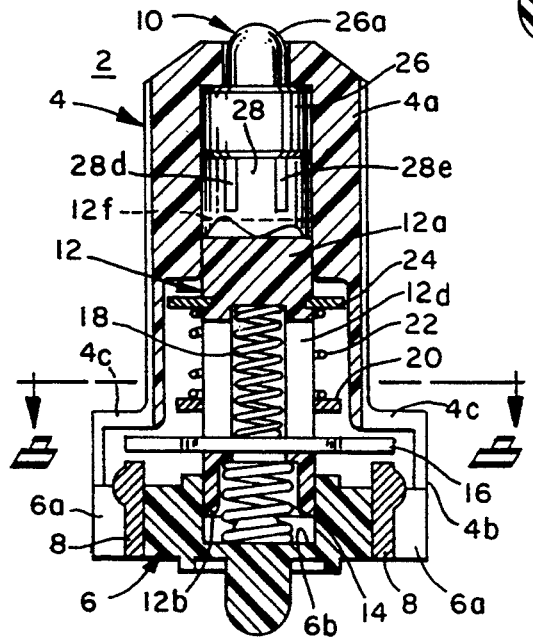
FIG. 2 is a center line cross sectional view of the switch of FIG. 1 taken in a plane parallel to the paper.

This invention provides an adjustment means for varying the gap dimension X after assembly of the switch 2. The invention provides a rotary adjustment cam member 28 shown separately in FIGS. 5–7 interposed the upper end of contact carrier 12 and the lower surface of operator 26. Adjustment cam member 28 is a molded plastic cylindrical tube having three diametrically extending grooves 28*a*, 28*b* and 28*c* rotatably spaced at equal intervals on its bottom surface. Grooves 28*a*–28*c* each have a different axial dimension or height; groove 28*a* being the shallowest groove, 28*c* being the deepest and groove 28*b* being at an intermediate depth between grooves 28*a* and 28*c* (See FIG. 6). The side surface of cam member 28 is provided with a pair of radially directed slots 28*d* and 28*e*. As seen in FIGS. 1, 3 and 4*a*–c, barrel portion 4*a* of housing 4 is provided with a window 4*d* adjacent the rotary adjustment cam member 28. The upper end of contact carrier 12 is provided with a diametrically disposed rib 12*f* which is overlaid by one of the slots 28*a*–28*c*. Rotary adjustment cam member 28 may be rotated by insertion of a tool (not shown) through window 4d to engage one of the slots 28*d* or 28*e*. When both slots are visible in the window as is represented in FIG. 1, the intermediate height groove 28*b* overlies rib 12*f* and the gap X is a median dimension. To decrease the gap dimension, the overall length of the plunger assembly 10 is increased by engaging slot 28*d* with a tool and rotating adjustment member 28 counterclockwise to the position shown in FIG. 4*c*, thereby moving the shallower groove 28*a* over rib 12*f*. To increase the gap dimension X, the overall length of plunger assembly 10 is effectively shortened by engaging slot 28*e* with a tool and rotating the adjustment member 28 clockwise to the position shown in FIG. 4*b*, wherein the deeper groove 28*c* is overlying the rib 12*f*. The spring 14 biases the plunger assembly 10 upward to an extended position wherein the cylindrical body of operator 26 bears against the shoulder of the reduced diameter opening of barrel 4*a*. The lower surface of operator 26 bears against the upper surface of rotary adjustment cam member 28. The respective grooves 28*a*–28*c* bear upon the fib 12*f* of contact carrier 12. All of these junctions determine the location of the lower edge of the window 12*d* in contact carrier 12 to determine the dimension X between the movable contacts 16 and 20 and the respective stationary contacts 8. The depth of the grooves 28*a*–28*c* can be held closely toleranced in manufacture of the member 28 such that the grooves 28*a* and 28*c* represent a plus or minus equal tolerance on opposite sides of the mean dimension represented by groove 28*b*. Thus the contacts can be set to close consistently after X amount of travel of the plunger assembly 10. Overtravel of plunger assembly 10 is permitted by the spring 18 which also provides contact pressure for the switch contacts.

In one preferred application, pushbutton switch 2 is mounted within a supplementary switch housing as shown in FIGS. 9–12. The supplementary switch housing comprises a molded cup-like case 30 of electrical insulating material having diametrically opposed pairs of wiring terminals 32 and 34 integrally molded therewith. Resilient spring clip electrical connectors 36 and 38 are attached to the respective wiring terminals 32 and 34 within the case 30 to extend upward along the side walls thereof. The spring clip conductors have a reverse bend portion facing inwardly. Pushbutton switch 2 is inserted within the cup-like cavity of case 30 such that spherical bosses 8*a* on stationary contacts 8 engage the re-entrant portion of reversely bent conductors 36 and 38 to make electrical connection therewith. A helical compression spring 40 rests at one end within a recess in the bottom of case 30 and at the other end within a spring seat formed on the underside of base 6 of switch 2 to bias the switch 2 upwardly relative to the case 30. An annular shoulder 30*a* is provided on the external surface of case 30 intermediate its ends. Annular shoulder 30*a* provides a substantially right angle shouldered upper surface and a curved shouldered lower surface. An O-ring 42 is disposed over the outer periphery of case 30 to rest against the right angle surface of annular shoulder 30*a*.

A metal bushing 44 provides the final portion of the supplementary housing for switch unit 2. Bushing 44 has a generally hexagonal main body which has a cylindrical flange 44a depending from its lower surface. A threaded bushing 44b projects upwardly from the upper surface of bushing 44. Bushing 44b is disposed over the barrel portion 4a of switch 2 and over the upper end of case 30 whereby a lower internal annular shoulder on bushing 44 bears against O-ring 42, compressing the same when the depending annular flange 44a is rolled over the lower rounded surface of annular ring 30a. The supplementary housing provides mounting for the switch 2 and electrical connection thereto. It also provides for major overtravel without damaging the switch 2 by permitting depression of the entire pushbutton switch 2 against the bias of spring 40. Depression of switch 2 slides the movable contacts 8 along the reentrant portions of conductive members 36 and 38 to maintain conductivity therebetween.

While the pushbutton switch with adjustment means of this invention has been shown in the best mode contemplated, it is understood that it is susceptible of various modifications without departing from the scope of the appended claims.

I claim:

1. A plunger operated switch comprising:

a housing having an opening through a wall thereof;

a plunger assembly guided for linear reciprocal movement within said housing along an axis extending through said opening to be operated through said opening, said plunger assembly comprising a contact carrier movable along said axis;

a pair of stationary contacts mounted in said housing on opposite sides of said plunger assembly contact carrier;

a movable contact carried by said contact carrier overlying said stationary contacts for movement by said plunger assembly into and out of bridging engagement with said stationary contacts;

means for biasing said plunger assembly to an extended position against said housing wall and said movable contact out of engagement with said stationary contacts;

said plunger assembly further comprising adjustment for adjusting an axial dimension of said plunger assembly between said wall and said movable contact, thereby adjusting initial spacing between said movable and stationary contacts in said extended position of said plunger assembly wherein said initial spacing is always greater than zero.

2. The plunger operated switch defined in claim 1 wherein said adjustment means comprises a rotary adjustment member rotatable about said axis, said rotary adjustment member having predetermined cam surfaces of varying axial dimension at an axial end thereof, and said contact carrier comprises a cam follower at an axial end thereof abutting a respective said cam surface.

3. The plunger operated switch defined in claim 2 wherein said rotary adjustment member is externally accessible for effecting rotation of said rotary adjustment member.

4. The plunger operated switch defined in claim 3 wherein said housing comprises a lateral wall extending substantially parallel to said linear reciprocal movement of said plunger assembly;

a window through said lateral wall aligned with said rotary adjustment member; and means on said rotary adjustment member accessible through said window for effecting rotation of said adjustment member.

5. The plunger operated switch defined in claim 4 wherein said means on said rotary adjustment member comprises at least one radially directed recess engageable by a tool inserted through said window.

6. The plunger operated switch defined in claim 4 wherein said means on said rotary adjustment member comprises a pair of radially directed recesses engageable by a tool through said window, at least one of said recesses being alighted with said window and accessible therethrough in every rotated position of said rotary adjustment member.

7. The plunger operated switch defined in claim 2 wherein said cam comprises a plurality of rotationally spaced diametrical grooves, each of said diametrical grooves having an axial depth different from axial depths of any other of said diametrical grooves, and said cam follower comprises a diametrically disposed rib on said contact carrier biased into a respective one of said grooves.

8. The plunger operated switch defined in claim 7 wherein said means for biasing said plunger assembly cooperates with said grooves and said rib for providing a rotational detent for said rotary adjustment member.

9. The plunger operated switch defined in claim 8 wherein said plunger assembly comprises an operator member disposed between said housing wall and said rotary adjustment member.

10. The plunger operated switch defined in claim 9 wherein said operator member comprises an axially extending pin projecting through said opening.

11. The plunger operated switch defined in claim 10 together with a supplementary housing comprising an internal chamber, an opening through said supplementary housing communicating with said chamber, and wiring terminals affixed to said supplementary housing and having conductive means extending into said chamber, said plunger operated switch being disposed in said chamber, a portion of said switch containing said operator extending through said supplementary housing opening externally thereof, said conductive means connecting said stationary contacts to said wiring terminals, and means biasing said switch to an extended position relative to said supplementary housing, said switch being depressible against said biasing means relative to said supplementary housing.

12. The plunger operated switch and supplementary housing as defined in claim 11 wherein said conductive means comprise resilient conductors extending parallel to movement of said switch in said chamber, and said stationary contacts comprise portions abutting said resilient conductors for sliding engagement therewith.

* * * * *